US005843302A

United States Patent [19]

Hood

[11] Patent Number: 5,843,302

[45] Date of Patent: Dec. 1, 1998

[54] SOLVENT DEASPHALTING UNIT CAPABLE OF GENERATING POWER

[75] Inventor: Richard L. Hood, Edmond, Okla.

[73] Assignee: Ormat Process Technologies, Inc., Sparks, Nev.

[21] Appl. No.: 764,264

[22] Filed: Dec. 12, 1996

[51] Int. Cl.[6] ..... C10C 3/00; B01D 11/00

[52] U.S. Cl. ..... 208/309; 208/311; 208/321; 208/322; 208/45; 196/14.52

[58] Field of Search ..... 208/309, 311, 208/321, 322, 337, 45; 196/14.52

[56] References Cited

U.S. PATENT DOCUMENTS

| | | | |
|---|---|---|---|
| 4,017,383 | 4/1977 | Beavon | 196/14.52 |
| 4,421,639 | 12/1983 | Lambert et al. | 208/309 |
| 4,784,753 | 11/1988 | Hotier et al. | 208/309 |

*Primary Examiner*—Walter D. Griffin
*Attorney, Agent, or Firm*—Donald M. Sandler

[57] ABSTRACT

Solvent deasphalting apparatus includes a separator that receives two inputs, a heavy hydrocarbon feed and a solvent feed; and the apparatus produces two outputs, an asphaltene/solvent stream and a deasphalted oil/solvent stream. A solvent recovery unit of the apparatus receives the two output streams and produces mainly a substantially solvent-free deasphalted oil product stream, a substantially solvent-free asphaltene product stream, and a recovered solvent stream which is returned to a solvent drum. A pump pumps a substantially constant volume of solvent from the solvent drum into a by-pass line connecting the pump to the solvent drum, and into a connection line connecting the pump to the separator. The amount of solvent flow in the connection line is functionally related to the level of heavy hydrocarbon feed so that solvent in excess of that flowing into the connection line and spills back to the solvent drum through the by-pass line. Finally, a power generator generates power in response to the flow of solvent in the by-pass line. The power generator includes a vaporizer for vaporizing solvent in the by-pass line, an organic vapor turbine responsive to vaporized solvent for expanding the vaporized solvent and producing expanded vaporized solvent, and generating power, a condenser for condensing the expanded vaporized solvent and producing condensed solvent, and a pump for returning the condensed solvent to the drum.

12 Claims, 2 Drawing Sheets

SOLVENT DEASPHALTING UNIT CAPABLE OF GENERATING POWER

TECHNICAL FIELD

This invention relates to a solvent deasphalting (SDA) unit capable of generating power.

BACKGROUND OF THE INVENTION

An SDA unit is usually associated with a petroleum refinery for the purpose of extracting valuable components from the heavy hydrocarbon by-product (termed residual oil, or vacuum residual) that remains after the refining process has extracted valuable lighter fractions, such as gasoline, from crude oil feed to the refinery. The operation of an SDA unit involves pumping a liquid, light hydrocarbon solvent (e.g., propane, iso- or normal butane, iso- or normal pentane, or mixtures thereof) into a separator which receives the heavy hydrocarbon feed produced by the petroleum refinery. Under appropriate conditions of temperature and pressure, phase separation occurs in the separator. From the top of the separator flows a stream that is substantially free of asphaltenes and contains deasphalted oil (DAO) and solvent; and from the bottom of the separator flows another stream that contains asphaltene and solvent within which some DAO is dissolved.

These streams are applied to the solvent recovery section of the SDA unit where most of the solvent is extracted from the streams and returned to the separator. The resultant solvent-free DAO may be returned to the refinery for conversion to gasoline, jet fuel, etc.; and the resultant solvent-free asphaltene can be combined with diluent, such as diesel fuel, for conversion to residual fuel oil.

In some installations, the solvent recovery section includes a supercritical solvent recovery section that removes a large percentage of solvent from the product streams, followed by an evaporative solvent recovery section that removes the balance of solvent. In other installations, only an evaporative solvent recovery section is used. In both cases, the output of the evaporative solvent recovery section is a DAO product stream and an asphaltene product stream, both streams having acceptable levels of solvent (e.g., 0.05% by weight), and a stream of condensed solvent that is returned to a solvent drum from which a pump draws to provide solvent to the separator.

The demand rate for solvent flowing into the separator is a function of the operating temperature of the separator, the feed rate of heavy hydrocarbon to the separator, and other factors. If the flow of solvent to the separator is insufficient to a solvent deasphalting unit that utilizes supercritical solvent recovery, the pressure in such unit may fall below the critical pressure of the solvent, and phase separation will not take place in the DAO separator. In addition, phase separation may not take pace in the separator with the result that the solvent deasphalting unit will shut down. To preclude this situation, the solvent pump is designed to have a solvent flow rate sufficiently in excess of the rate satisfactory for the design conditions to accommodate significant changes in operational temperature, feed rates, etc. Excess solvent flow provided by the pump is spilled-back to the solvent drum by a by-pass.

For example, a solvent deasphalting plant designed to process 30,000 barrels per stream day (BPSD) of heavy hydrocarbon feed typically will pump solvent at a rate of about 150% of the feed, namely about 45,000 BPSD. On the average, the ratio of solvent to feed is about 0.8 with the result that about 24,000 BPSD of solvent is pumped from the solvent drum into the separator, and about 21,000 BPSD is spilled back to the solvent drum through a by-pass line.

A considerable amount of power is consumed because of the spill-back requirements of the solvent deasphalting unit; and it is an object of the present invention to provide a new and improved solvent deasphalting unit which, while maintaining the required spill-back operation, consumes less energy than conventional solvent deasphalting units.

BRIEF DESCRIPTION OF THE INVENTION

According to the present invention, a solvent deasphalting apparatus includes a separator which receives two inputs, a heavy hydrocarbon feed and a solvent feed, and produces two outputs, an asphaltene/solvent stream and a deasphalted oil/solvent stream. The apparatus also includes a solvent recovery unit responsive to the output streams for producing a substantially solvent-free deasphalted oil product stream, a substantially solvent-free asphaltene product stream, and a recovered solvent stream. A solvent drum receives the recovered solvent stream; and a pump pumps a substantially constant volume of solvent from the solvent drum independently of, and in excess of, the rate needed to process the heavy hydrocarbon feed into the separator.

The pumped solvent flows into a connection line connecting the pump to the separator, and into a by-pass line connecting the pump to the solvent drum. The amount of solvent flow in the connection line is functionally related to the flow rate of the heavy hydrocarbon feed so that solvent in excess of that flowing into the connection line spills back to the solvent drum through the by-pass line.

Finally, a power generator generates power in response to the flow of solvent in the by-pass line. Preferably, the power generator includes a vaporizer for vaporizing solvent in the by-pass line, an organic vapor turbine responsive to vaporized solvent for expanding the vaporized solvent and producing expanded vaporized solvent, and for generating power, and a condenser for condensing the expanded vaporized solvent and producing condensed solvent that is returned to the drum. In this manner, considerably more energy than the amount of energy expended to maintain the spill-back flow is produced by the power generator.

BRIEF DESCRIPTION OF THE DRAWINGS

An embodiment of the present invention is described by way of the example with reference to the accompanying drawings wherein.

DETAILED DESCRIPTION

Figure 1:
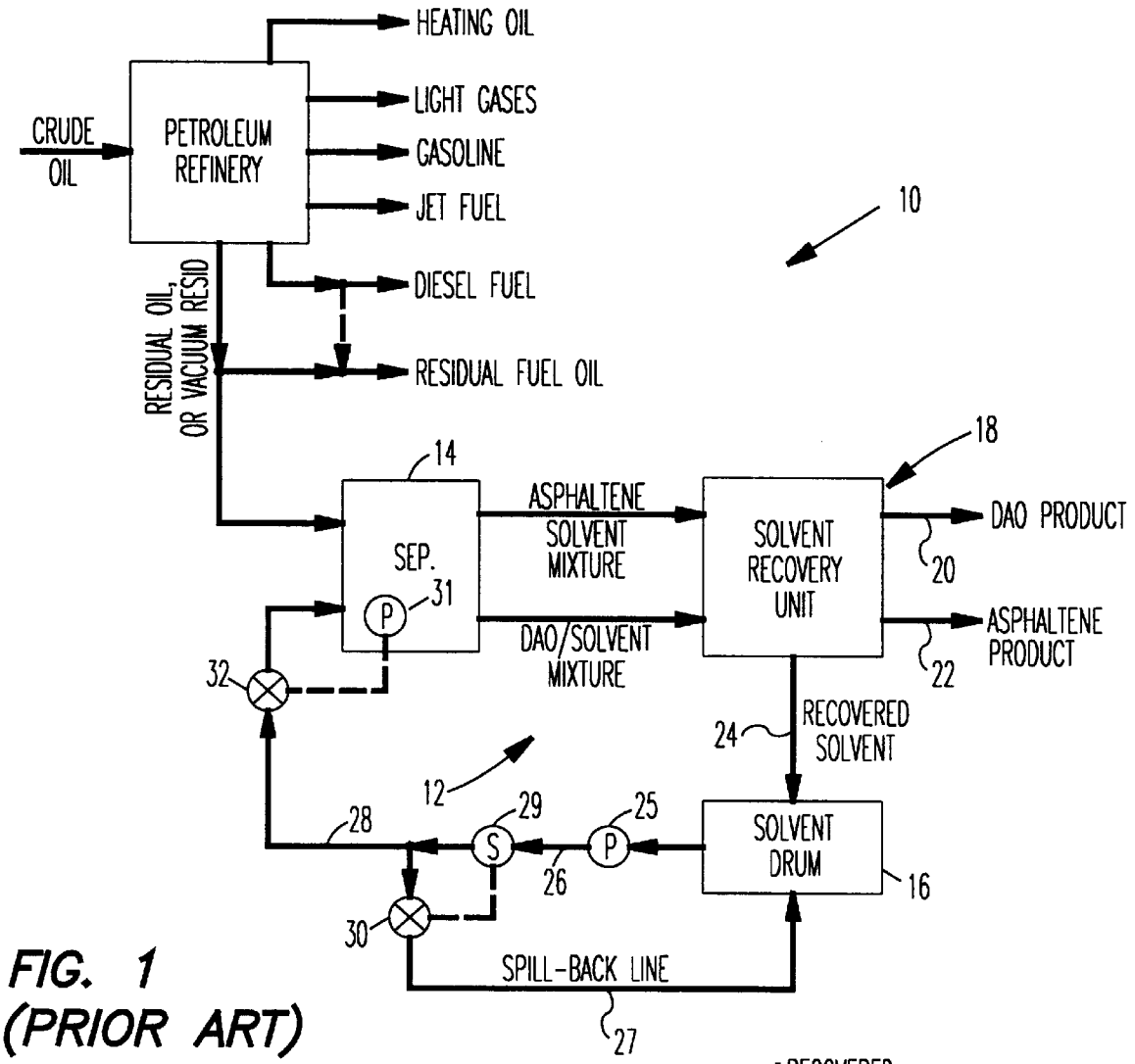
FIG. 1 (PRIOR ART)
FIG. 1 is a block diagram of a conventional solvent deasphalting unit showing the spill-back line associated with the solvent recovery unit.

Referring now to FIG. 1, reference numeral 10 designates a typical petroleum refinery that receives crude oil and primarily produces gasoline, jet fuel, diesel fuel, and heating oil. Light gases produced in the refinery process are typically sold, or used outside the refinery as fuel. A heavy, viscous hydrocarbon sometimes referred to as residual oil, or vacuum residual, is the residue of the refinery. Typically, this residue is converted to residual fuel oil by blending with diesel fuel to reduce viscosity, and sold to electric utilities as fuel. This blending process is indicated by the broken lines connecting the diesel fuel output of the refinery to the residual oil output.

An alternative, or supplemental, way to dispose of the residual oil is to utilize a solvent deasphalting (SDA) unit designated by reference numeral 12 which includes separator 14 which receives two inputs: the heavy hydrocarbon residue feed from the refinery, and a light hydrocarbon solvent feed from solvent drum 16. Under appropriate conditions of temperature and pressure, phase separation occurs in the separator from the top of which flows a stream that is a mixture of asphaltene and solvent, and from the bottom of which flows a stream that is a mixture of deasphalted oil (DAO) and solvent.

The SDA unit also includes solvent recovery section 18 which receives the two streams from the separator, and is effective to produce mainly two product streams. That is to say, the SDA unit produces substantially solvent-free DAO product stream 20, substantially solvent-free asphaltene product stream 22, and recovered solvent stream 24 which is returned to solvent drum 16. Some SDA units also produce one or more product streams which are intermediate cuts or products, typically called resins, whose properties lie between the DAO product and the asphaltene product.

The solvent recovery unit may utilize a supercritical solvent recovery process to first remove a great deal of solvent from the DAO stream, the balance of the solvent in the DAO stream being removed by an evaporative solvent recovery process that also operates on the heavier streams produced by the SDA unit. If supercritical solvent recovery is not used as the primary means to recover solvent from the DAO, an evaporative solvent recovery process would operate on all of the streams.

The DAO product stream usually is recycled back to the refinery for conversion to gasoline, jet fuel, diesel fuel, and heating oil. The asphaltene product stream may be blended with a lighter, lower viscosity diluent such as diesel fuel, and converted to residual fuel oil for sale to utilities, or in some cases, sold as solid fuel.

SDA units having supercritical and/or evaporative solvent recovery sections are well known in the art; and the details of such units do not form a part of the present invention. For reference purposes, however, mention is made of co-pending application Ser. Nos. 08/572,185 filed Dec. 13, 1995, and 08/618,570 filed Mar. 20, 1996, the disclosures of both of which are hereby incorporated by reference, as specific examples of SDA units that have evaporative solvent recovery units.

Smooth operation of SDA unit 12 requires a steady flow rate of solvent from solvent drum 16 to separator 14, and in the case of feed rate fluctuations, wide swings in the delivery rate of solvent to the separator must be accommodated. This is conventionally achieved by utilizing a spill-back arrangement in which a pump, having a capacity larger than that required to process the average hydrocarbon feed to the separator, supplies solvent at a rate appropriate to the instantaneous rate of heavy hydrocarbon feed, with the excess solvent being spilled-back to the solvent drum via a by-pass line.

Specifically, SDA unit 12 includes pump 25 having outlet 26 for pumping a substantially constant volume of solvent from solvent drum 16, by-pass (or spill-back) line 27 connecting outlet 26 of the pump to the solvent drum, and connection line 28 connecting outlet 26 of the pump to separator 14. Sensor 29 in outlet 26 which controls valve 30 in by-pass line 27, and sensor 31 in separator 14 which controls valve 32 in connection line 28, constitute means for functionally relating the amount of solvent flow in the connection line to the flow rate of heavy hydrocarbon feed to the separator. Solvent in excess of that flowing into the connection line spills back to the solvent drum through by-pass line 27. Since the capacity of pump 25 is typically about 50% greater than the design flow of feed to the separator, a considerable amount of fluid flows in the by-pass line. For example, in order to satisfy the steady state demand of the asphaltene separator and demand upsets for a 30,000 BPSD heavy hydrocarbon feed, flow sensor 29 controlling valve 30 ensures that about 45,000 BPSD of solvent will be pumped from the solvent drum to a pressure near the pressure in separator 14 of the supercritical section of the SDA unit, regardless of the amount of solvent reaching the separator. Thus, on the average, about 24,000 BPSD of solvent reaches the separator, the balance, about 21,000 BPSD being spilled-back to the solvent drum through by-pass line 27.

All of the energy expended in pumping fluid into the by-pass is wasted; and the present invention provides a way to recover this wasted energy and more.

According to the present invention, a power generator is provided for generating power in response to flow of solvent in the by-pass line. While a hydraulic turbogenerator can be used to generate power from the flow of solvent in the by-pass, it is preferred to use the solvent as the working fluid of an organic Rankine cycle power plant.

Figure 2:
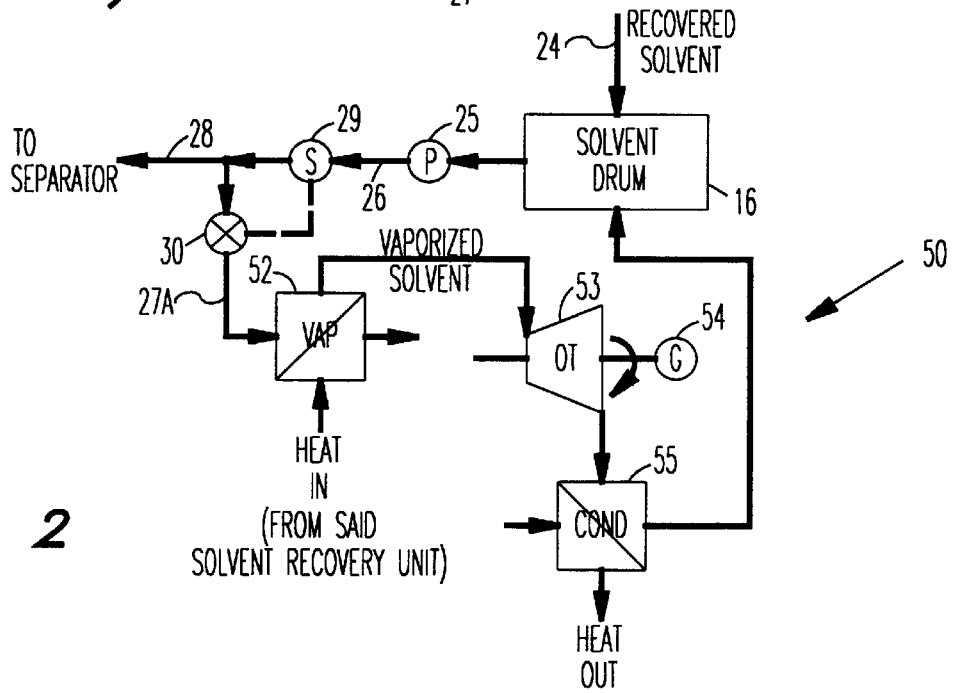
FIG. 2 is a block diagram of one embodiment of the present invention for recovering energy from the flow of solvent in the spill-back line.

In the embodiment of the invention shown in FIG. 2, organic Rankine cycle power generator 50 includes vaporizer 52 for heating solvent in by-pass line 27A and producing vaporized solvent, organic vapor turbine 53 connected to generator 54, and condenser 55. Turbine 53 is responsive to vaporized solvent produced by vaporizer 52 for generating power and producing expanded vaporized solvent which is directed to condenser 55 wherein the expanded vaporized solvent is condensed into condensed solvent. Condenser 55 may operate at a pressure large enough to effect the transfer of condensed solvent from the condenser to drum 16.

Heat for use by the vaporizer may be obtained from the refinery or from the SDA unit. For example, heat may be obtained from the DAO product stream of the SDA, or from the asphaltene product stream after it has been diluted with cutter stock to produce fuel oil. Alternatively, such heat could be derived by cooling recovered solvent produced by the SDA before such solvent is condensed and sent via line 24 to the solvent drum. In a further alternative, heat may be derived from burning asphaltene product.

Condenser 55 may be air-cooled and reject heat into the atmosphere, or it may be liquid cooled.

Because of the volumetric flow of solvent in the by-pass line necessary to ensure smooth operation of the SDA unit, a considerable amount of potential power is involved. For a plant passing on the average 21,000 BPSD of solvent through the by-pass line, the potential power available will be about 860 KW. The power consumed to provide the indicated spill-back is about 245 KW resulting in net production of about 615 KW. The cost of such production is the cost of the components of the power generator, i.e., the heat exchangers, turbine and generator.

Figure 3:
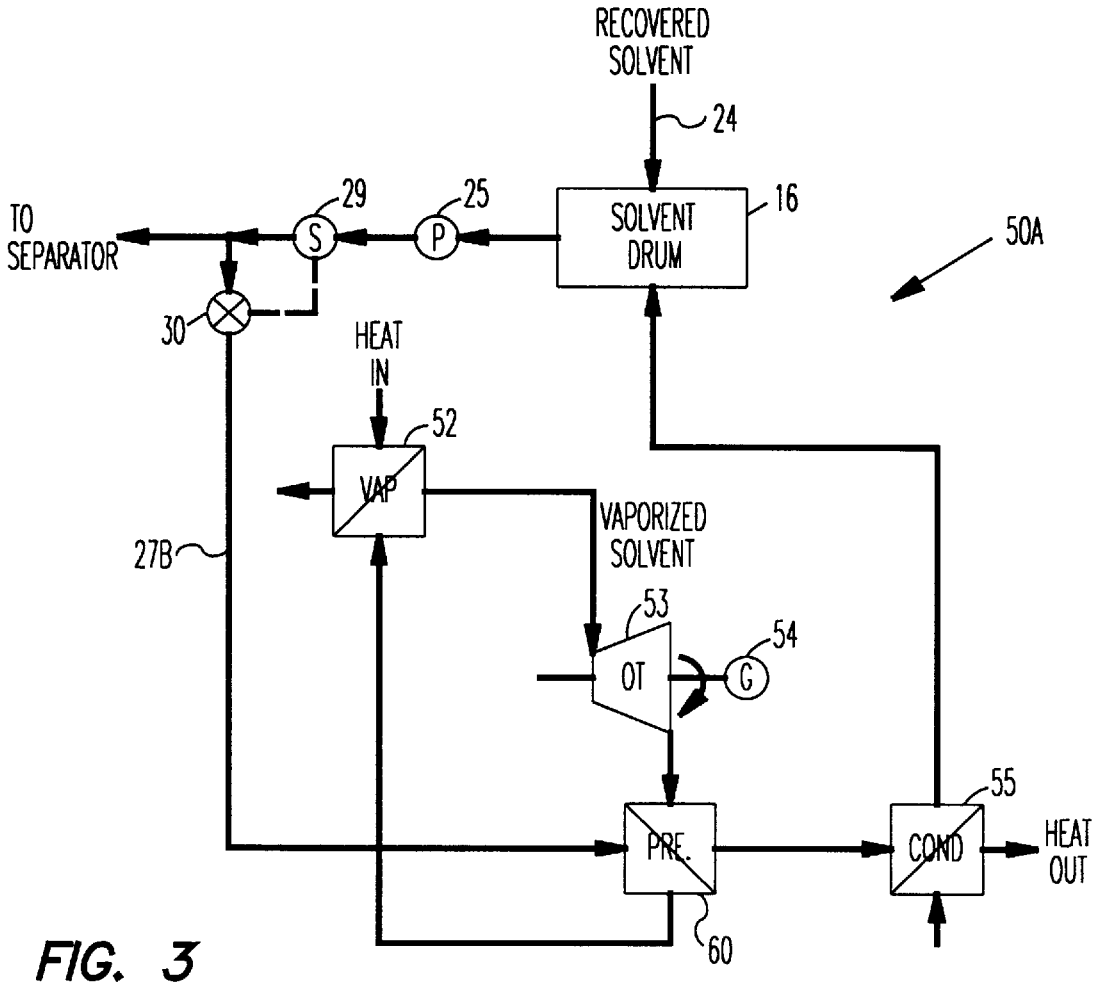
FIG. 3 is a block diagram of a second embodiment of the present invention for recovering energy from the flow of solvent in the spill-back line.

In the second embodiment of the invention shown in FIG. 3, power plant 50A utilizes a preheater for preheating the solvent using superheat heat contained in the turbine exhaust before the preheated solvent is vaporized. As indicated, plant 50A includes preheater 60 for preheating solvent in by-pass line 27B and producing preheated solvent that is supplied to vaporizer 52 wherein the solvent is vaporized. Plant 50A further includes organic vapor turbine 53 connected to generator 54, and condenser 55. Turbine 53 is responsive to vaporized solvent produced by vaporizer 52 for generating power and producing expanded vaporized solvent which is directed to preheater 60 wherein the expanded vaporized solvent gives up some of its superheat to preheat the solvent in line 27B. The heat depleted vaporized solvent that exits from preheater 60 is supplied to condenser 55 which produces condensed solvent. Condenser 55 may operate at a pressure large enough to effect the transfer of condensed solvent from the condenser to drum 16.

Heat for use by the vaporizer may be obtained from the refinery or from the SDA unit. For example, heat may be obtained from the DAO product stream of the SDA, or from the asphaltene product stream after it has been diluted with cutter stock to produce fuel oil. Alternatively, such heat could be derived by cooling recovered solvent produced by the SDA before such solvent is condensed and sent via line 24 to the solvent drum. In a further alternative, heat may be derived from burning asphaltene product.

Condenser 55 may be air-cooled and reject heat into the atmosphere, or it may be liquid cooled.

The advantages and improved results furnished by the method and apparatus of the present invention are apparent from the foregoing description of the preferred embodiment of the invention. Various changes and modifications may be made without departing from the spirit and scope of the invention as described in the appended claims.

What is claimed is:

1. Solvent deasphalting apparatus comprising:

a) a separator for receiving a heavy hydrocarbon feed and a solvent feed for producing an asphaltene/solvent stream and a deasphalted oil/solvent stream;

b) a solvent recovery unit responsive to said asphaltene/solvent stream and said deasphalted oil/solvent stream for producing a substantially solvent-free deasphalted oil product stream, a substantially solvent-free asphaltene product stream, and a recovered solvent stream;

c) a solvent drum for receiving said recovered solvent stream;

d) a pump having an outlet for pumping a substantially constant volume of solvent from said solvent drum;

e) a by-pass line connecting the outlet of the pump to the solvent drum;

f) a connection line connecting the outlet of the pump to said separator;

g) means in said by-pass line and said connection line for functionally relating the amount of solvent flow in said connection line to the flow rate of said heavy hydrocarbon feed so that solvent in excess of that flowing into said connection line spills back to said solvent drum through said by-pass line; and h) a power generator for generating power in response to the flow of solvent in said by-pass line;

i) wherein said power generator includes:

(1) a vaporizer for heating solvent in said by-pass line and producing vaporized solvent;

(2) an organic vapor turbine responsive to said vaporized solvent for generating power and producing expanded vaporized solvent;

(3) a condenser for condensing said expanded vaporized solvent and producing condensed solvent; and (4) means for returning said condensed solvent to said drum.

2. Solvent deasphalting apparatus according to claim 1 including means for supplying heat to said vaporizer from said solvent recovery unit.

3. Solvent deasphalting apparatus according to claim 1 wherein said condenser is air-cooled.

4. Solvent deasphalting apparatus according to claim 1 including a preheater for preheating solvent in said by-pass line using heat contained in said expanded vaporized solvent to produce preheated solvent, and means for supplying said preheated solvent to said vaporizer.

5. Solvent deasphalting apparatus having a heated process stream that requires cooling, said apparatus comprising:

a) a separator for receiving a heavy hydrocarbon feed and a solvent feed for producing an asphaltene/solvent stream and a deasphalted oil/solvent stream;

b) a solvent recovery unit responsive to said asphaltene/solvent stream and said deasphalted oil/solvent stream for producing a substantially solvent-free deasphalted oil product stream, a substantially solvent-free asphaltene product stream, and a recovered solvent stream;

c) a solvent drum for receiving said recovered solvent stream;

d) a pump having an outlet for pumping a substantially constant volume of solvent from said solvent drum;

e) a by-pass line connecting the outlet of the pump to the solvent drum;

f) a connection line connecting the outlet of the pump to said separator;

g) means in said by-pass line and said connection line for functionally relating the amount of solvent flow in said connection line to the flow rate of said heavy hydrocarbon feed so that solvent in excess of that flowing into said connection line spills back to said solvent drum through said by-pass line; and h) an indirect-contact heat exchanger responsive to said process stream for heating solvent in said by-pass line and cooling said process stream.

6. Solvent deasphalting apparatus according to claim 5 wherein said indirect-contact heat exchanger includes a vaporizer for heating solvent in said by-pass line and producing vaporized solvent.

7. A solvent deasphalting unit according to claim 6 including means for transferring heat in said vaporized solvent to another fluid.

8. A solvent deasphalting unit according to claim 7 wherein said another fluid is a liquid.

9. A solvent deasphalting unit according to claim 6 including an organic vapor turbine for expanding said vaporized solvent, and a generator driven by said organic vapor turbine for generating power.

10. A solvent deasphalting unit according to claim 6 including:

a) an organic vapor turbine responsive to said vaporized solvent for generating power and producing expanded vaporized solvent;

b) a condenser for condensing said expanded vaporized solvent and producing condensed solvent; and c) means for returning said condensed solvent to said drum.

11. A method for operating a solvent deasphalting unit comprising the steps of:

a) applying both a solvent from a solvent storage drum, and a heavy hydro-carbon feed to a separator which produces an asphaltene/solvent stream and a deasphalted oil/solvent stream;

b) processing said asphaltene/solvent stream and said deasphalted oil/solvent stream for producing a substantially solvent-free deasphalted oil product stream, a substantially solvent-free asphaltene product stream, and a recovered solvent stream;

c) storing said recovered solvent stream in said solvent drum;

d) pumping a substantially constant volume of solvent from said solvent drum in excess of that required by said separator;

e) delivering to said separator a portion of the pumped solvent;

f) vaporizing said excess solvent to produce vaporized solvent; and g) expanding said vaporized solvent in an organic vapor turbine for producing power and expanded vaporized solvent.

12. A method according to claim 11 including:

a) condensing said expanded vaporized solvent to a liquid; and b) returning said liquid to said solvent drum.

* * * * *